United States Patent [19]

Saito et al.

[11] Patent Number: 4,482,067

[45] Date of Patent: Nov. 13, 1984

[54] SYNTHETIC RESIN BOTTLE

[75] Inventors: Tadao Saito, Adachi; Riichi Ogawa, Koto, both of Japan

[73] Assignee: Yoshino Kogyosho Co., Ltd., Japan

[21] Appl. No.: 580,767

[22] Filed: Feb. 21, 1984

Related U.S. Application Data

[63] Continuation of Ser. No. 352,718, Feb. 26, 1982, abandoned.

[30] Foreign Application Priority Data

Mar. 5, 1981 [JP] Japan ..... 56-31199

[51] Int. Cl.[3] ..... B65D 23/00; B65D 21/02

[52] U.S. Cl. ..... 215/12 R; 215/100 R; 206/509; 220/69

[58] Field of Search ..... 215/10, 12 R, 100 R, 215/100.5, 1 C; 206/503, 509; 220/4 C, 69, 4 D

[56] References Cited

U.S. PATENT DOCUMENTS

| | | | |
|---|---|---|---|
| D. 173,780 | 1/1955 | Benson . | |
| 1,746,332 | 2/1930 | Barroll | 206/509 |
| 2,119,745 | 6/1938 | Ingersoll | 206/503 |
| 2,576,725 | 11/1951 | Schoelles | 215/10 |
| 3,387,749 | 6/1968 | Godshalk et al. | 215/10 X |
| 3,482,724 | 12/1969 | Heaton | 215/100 R X |
| 3,722,725 | 3/1973 | Khetani et al. | 220/69 X |
| 3,738,529 | 6/1973 | Rose | 215/100.5 X |
| 4,114,759 | 9/1978 | Maloney | 215/12 R X |
| 4,127,207 | 11/1978 | Hubert et al. | 215/10 X |

FOREIGN PATENT DOCUMENTS

| | | | |
|---|---|---|---|
| 1494984 | 8/1967 | France | 215/12 R |
| 39-35880 | 12/1964 | Japan . | |
| 45-35474 | 11/1970 | Japan . | |
| 46-18398 | 6/1971 | Japan . | |
| 47-34621 | 10/1972 | Japan . | |
| 50-39309 | 11/1975 | Japan . | |
| 51-70086 | 6/1976 | Japan . | |
| 55-98738 | 7/1980 | Japan . | |
| 57-24231 | 2/1982 | Japan . | |
| 987133 | 3/1965 | United Kingdom | 206/509 |
| 2029364 | 3/1980 | United Kingdom | 206/503 |
| 658042 | 4/1979 | U.S.S.R. | 220/69 |

*Primary Examiner*—William Price
*Assistant Examiner*—Sue A. Weaver
*Attorney, Agent, or Firm*—Parkhurst & Oliff

[57] ABSTRACT

A round-bottomed bottle is made standable by fitting a cylindrical base to the lower part of the bottle. In addition, an upper fitting member is attached to the upper part of the bottle. A concave part formed on the cylindrical peripheral wall of the upper fitting member makes it easy to pour the liquid contents into a glass.

7 Claims, 3 Drawing Figures

SYNTHETIC RESIN BOTTLE

This is a continuation of application Ser. No. 352,718 filed Feb. 26, 1982, now abandoned.

BACKGROUND OF THE INVENTION

1. Field of the Invention

The present invention relates to a round-bottomed synthetic resin bottle having such a structure as to stand the bottle and facilitate pouring or liquid contained therein.

2. Description of the Prior Art

Blowing the bottle bottom into a spherical shape is a recent technology to accomplish biaxial orientation. A round-bottomed bottle produced by such technology is allowed to stand on a cylindrical base fitted to the bottom. A bottle of such structure, however, is poor in appearance. To make the bottle look balanced in structure, it has been devised to fit a member like the cylindrical base to the top of the bottle. This device still is not a solution; the upper cylindrical member causes inconvenience to pouring of liquid from the bottle.

SUMMARY OF THE INVENTION

It is an object of the present invention to provide a round-bottomed synthetic resin bottle fitted with a cylindrical base member that permits the bottle to stand upright and fitted also with a cylindrical upper member which matches with the external configuration of the bottle and protects the cap of the mouth. The cylindrical upper member is of such a structure that does not cause inconvenience to pouring of liquid from the bottle. In addition, the base member and upper member facilitate stacking of bottles.

DETAILED DESCRIPTION OF THE INVENTION

Figure 1:
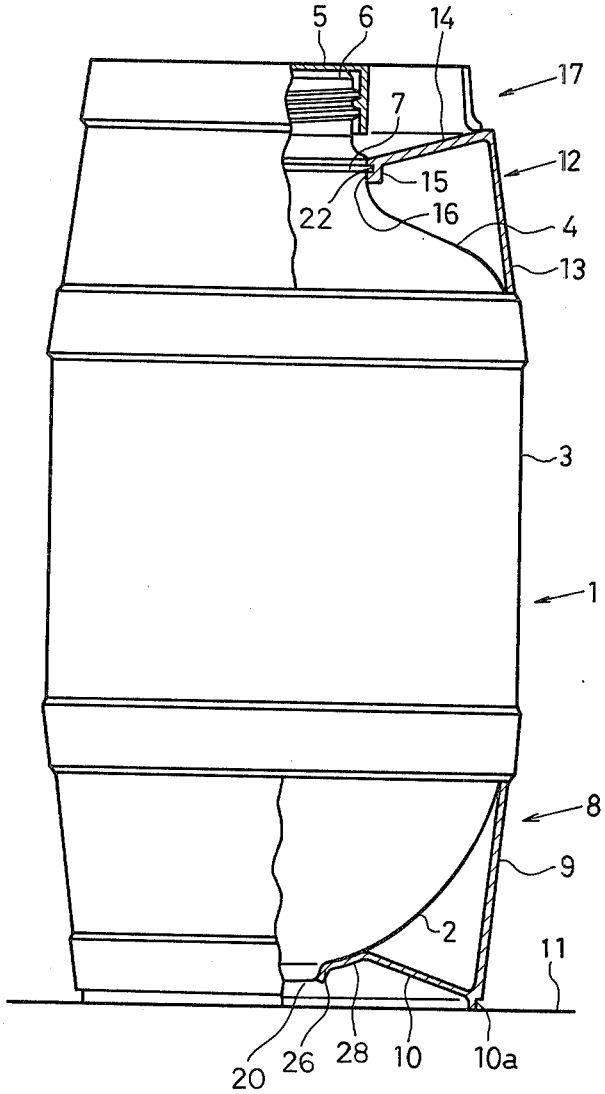
FIG. 1 is a partly cutaway front view of a synthetic resin bottle of this invention.
Figure 2:
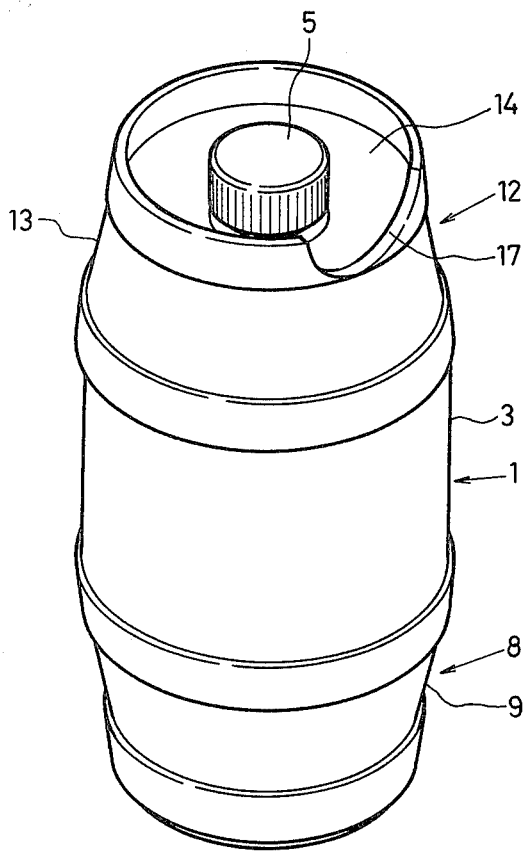
FIG. 2 is a perspective view of the synthetic resin bottle.

A synthetic resin bottle of this invention will be described with reference to the drawings.

The thin-walled bottle proper 1 which holds liquid is molded by biaxial orientation of cold parison. The cold parison which is of cylindrical shape having a bottom and an upper opening is injection-molded from PET or PVC. The bottle proper 1 has the bottom wall 2, the body 3 which extends upward from the periphery of the bottom, the shoulder 4 on the top of the body, and the narrow threaded neck 6 extending upward from the shoulder 4. The neck 6 is fitted with the cap 5. At the base of the neck is the flange 7 extending outward. The bottom wall 2 is molded in a spherical shape which is convex downward. At the most extreme end of bottom wall 2 is a substantially circular projection 20 concentric with the longitudinal axis of the bottle. This circular projection 20 extends longitudinally downward from the bottom of said bottle.

The body proper is fitted at its lower part with the cylindrical base 8 made of synthetic resin. The base has the peripheral wall 9 into which the lower external surface of the body is fitted. The peripheral wall 9 has at its lower end the upwardly and inwardly extending flangelike supporting member 10 which supports the bottom of the bottle proper. This inwardly extending flange-like member 10 can be secured snugly against the circular projection 20. In a preferred embodiment, flange 10 can comprise at least two integral portions, 26 and 28 forming a bent member for fitting said flange 10 snugly against circular projection 20 and said bottom of said bottle. The base 8 fitted to the lower part of the body 3 permits the bottle to stand upright on the horizontal plane 11. The base should preferably be provided with the vertical fitting cylinder **10*a*** at its lower end, as will be mentioned later.

Figure 3:
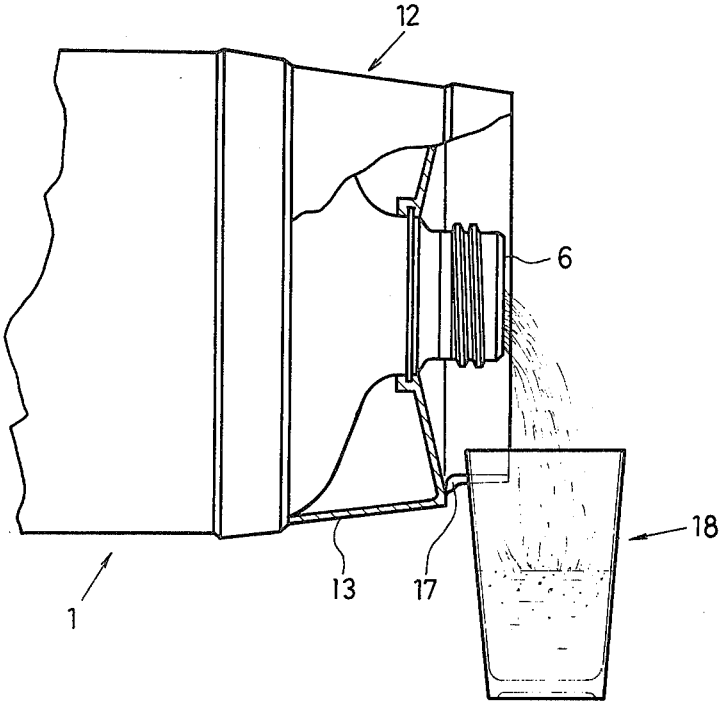
FIG. 3 is a partly sectional view of the synthetic resin bottle in use.

The upper part of the bottle proper 1 is fitted with the upper fitting member 12 made of synthetic resin. This member consists of the peripheral wall 13, having an upper wall portion and a lower wall portion. The upper wall portion is defined from the lower wall portion by a boundary. The boundary has an inwardly extending flange 14 extending therefrom. The lower wall portion is fitted to the upper external periphery of the body of the bottle proper, and the inwardly extending flange 14 extends downwardly from the upper part thereof. Flange 14 is C-shaped at one end. The hole 22 of the C-shaped flange passes the neck 6 of the bottle proper, and has the peripheral wall 15 with which the outward outwardly extending flange on the bottle proper is fitted. The peripheral wall 15 has the fitting rib 16. The upper fitting member 12 is mounted in such a manner that when it is fitted to the upper part of the bottle proper, the top of the neck or the cap 5 screwed to the neck of the bottle proper does not protrude beyond the upper end of the peripheral wall of the fitting member. The inside diameter of the peripheral wall is approximately equal to the outside diameter of the above-mentioned fitting cylinder **10*a*, so that a plurality of bottles can be stacked by fitting the fitting cylinder 10*a* to the top of the peripheral wall 13 of the other bottle. The concave part 17 is formed by cutting partially the upper part of the peripheral wall of the upper fitting member. This concave part permits a glass 18 to get near the neck 6 of the bottle when the liquid in the bottle is poured into the glass, as shown in FIG. 3**. Thus, the concave part is wide enough to admit the glass.

The synthetic resin bottle of this invention is composed of the bottle proper 1, the cylindrical base 8 fitted to the bottom of the bottle, and the upper fitting member 12 fitted to the upper part of the bottle. Therefore, the bottle can stand upright in spite of the spherical bottom wall, and the bottle has a balanced appearance. In addition, the base and the upper member can be easily fitted for stacking. The upper fitting member taller than the neck protects the cap, keeping the contents sealed completely. The concave part 17 formed on the upper fitting member facilitates pouring of the liquid contents into a glass.

What is claimed is:

1. A synthetic resin container comprising:

(A) an integral, thin-walled, biaxially oriented bottle having a longitudinal axis and comprising a top portion, a cylindrical body portion and a semi-spherical bottom portion;

said top portion comprising a shoulder portion sloping from said cylindrical body portion toward said longitudinal axis, a first cylindrical neck portion extending along said longitudinal axis from said shoulder portion and comprising a radially outwardly extending flange, and a second cylindrical neck portion extending along said longitudinal axis from said first neck portion and comprising annular threads for securing a cap thereto; and (B) an upper fitting member disposed symmetrically about said longitudinal axis and comprising a peripheral upper wall portion, a peripheral lower wall portion and a first inwardly extending flange defining a boundary between said peripheral upper wall portion and said peripheral lower wall portion;

said peripheral upper wall portion extending at least as high as said second cylindrical neck portion and having a part-circular opening therethrough for permitting a vessel to be passed therethrough and disposed adjacent said second cylindrical neck portion;

said peripheral lower wall portion comprising a lower end fitted to a periphery of said bottle; and said first flange sloping towards said longitudinal axis and further comprising means for securing said first flange to said radially outwardly extending flange of said first cylindrical neck portion; and (C) a lower fitting member disposed symmetrically about said longitudinal axis and comprising a peripheral wall having top and bottom end portions, and a second inwardly extending flange integral with said bottom end portion;

said top end portion being in fitting relationship with a periphery of said bottle;

said bottom end portion comprising a longitudinal cylindrical extension adapted for supporting said container in an upright position and having an outer diameter no larger than an inner diameter of said peripheral upper wall portion of said upper fitting member; and said second flange sloping towards said longitudinal axis, and comprising means for securing said second flange to said bottom portion of said bottle.

2. A synthetic resin container as claimed in claim 1, wherein said first flange further comprises a C-shape portion at the end thereof for fitting said first flange onto the outwardly extending flange of said first cylindrical neck portion of said bottle.

3. A synthetic resin container as claimed in claim 1, wherein a circular projection concentric with said longitudinal axis extends longitudinally downward from said semi-spherical bottom portion of said bottle.

4. A synthetic resin container as claimed in claim 3, wherein said means for securing said second flange to said bottom portion of said bottle comprises means for fitting said second flange against said circular projection on said bottom portion of said bottle.

5. A synthetic resin container as claimed in claim 4, wherein said means for securing said second flange to said bottom portion of said bottle comprises at least two integral portions of said second flange with said integral portions forming a bent member for snugly fitting against said bottom portion and said circular projection of said bottle.

6. A synthetic resin container as claimed in claim 1, wherein said first flange is downwardly sloping.

7. A synthetic resin container as claimed in claim 1, wherein said second flange is upwardly sloping and said first flange is downwardly sloping.

* * * * *